US005727823A

United States Patent [19]

Wiley

[11] Patent Number: 5,727,823

[45] Date of Patent: Mar. 17, 1998

[54] SEMITRACTOR DOOR BAR

[76] Inventor: Vernetta F. Wiley, 717 Glenway St., Madison, Wis. 53711-1721

[21] Appl. No.: 720,535

[22] Filed: Sep. 30, 1996

[51] Int. Cl.[6] ..... E05C 19/18

[52] U.S. Cl. ..... 292/289; 292/259 R

[58] Field of Search ..... 292/288, 289, 292/259 R, 145

[56] References Cited

U.S. PATENT DOCUMENTS

| | | | |
|---|---|---|---|
| 313,942 | 3/1885 | Knauer | 292/259 R |
| 327,373 | 9/1885 | Yarnall et al. | 292/259 R |
| 521,870 | 6/1894 | Smith | 292/259 R |
| 527,104 | 10/1894 | Benninger | 292/259 R |
| 698,326 | 4/1902 | Schwab | 292/259 R |
| 3,117,532 | 1/1964 | Moorhead . | |
| 3,631,628 | 1/1972 | Bahnsen . | |
| 3,806,179 | 4/1974 | Roessle | 292/259 R |
| 3,865,426 | 2/1975 | Barnhart . | |
| 3,980,328 | 9/1976 | Pearson . | |
| 4,252,066 | 2/1981 | Adler et al. . | |
| 4,466,260 | 8/1984 | Panetta . | |
| 4,627,248 | 12/1986 | Haworth . | |
| 4,819,461 | 4/1989 | Pearson | 292/259 R X |
| 5,077,940 | 1/1992 | LaRose, Jr. | 292/259 R X |
| 5,168,732 | 12/1992 | Chen et al. | 70/209 |
| 5,474,343 | 12/1995 | Ledbetter | 292/259 R |
| 5,556,143 | 9/1996 | Robinson | 292/289 X |

*Primary Examiner*—Rodney M. Lindsey
*Attorney, Agent, or Firm*—Teresa J. Welch; Stroud, Stroud, Willink, Thompson & Howard

[57] ABSTRACT

A door bar for barring the door of an automotive vehicle of the type wherein the door has doorjambs, an inside door pull handle for closing the door and a space between the inside door pull handle and the door for receiving a hand, includes a rigid elongate unitary structure with a bar and a panel depending from, e.g., extending perpendicularly from, the bar. The bar has a longitudinal axis and the panel extends abaxially from the bar. The door bar is configured and dimensioned to be positioned between the pull handle and the door and extends from a point prior to the pull handle across the door to beyond the door jamb to bar the door from being opened.

16 Claims, 5 Drawing Sheets

SEMITRACTOR DOOR BAR

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

This invention relates generally to a door bar device and in particular, to door bar that is particularly well-suited for securing the doors of a semitractor.

Many anti-theft/anti-break-in devices for automotive vehicles are present in the market. Some take into consideration the locking of the steering, others the break of an electric circuit or the locking of the brake circuit. Nonetheless, there remains a great deal of breaking and entering of locked vehicles.

A more recent problem that has arisen, largely unattended in the art, is the breaking and entering of semitractors while the drivers (and some members of their families or friends) are sleeping or otherwise present in the semitractor. Modern semitractors have compartments behind the cab in which a driver(s) can sleep, watch television, utilize a microwave oven, etc. As knowledge that semitractors serve as a mobile home for truckers becomes more widespread, break-ins present a significant security problem for the drivers. Drivers at rest-stops are particularly susceptible to break-ins because they are typically sleeping, and a number of violent crimes toward sleeping drivers have occurred. The problem is compounded because the diesel engines of the semitractors are left running and obscure or drown out noise. Some drivers have attempted to foil burglars by rigging the seat belt around the door handle which permits the door to open only to a small degree. However, burglars, who have access to many tools, can easily cut a seat belt.

Variously door control and lock mechanisms have been described. See, e.g., U.S. Pat. No. 4,252,066 issued to Adler et al. and U.S. Pat. No. 3,631,628 issued to Bahnsen. Door bar and door latch systems, generally, have also been described. See, e.g., U.S. Pat. No. 3,980,328 issued to Pearson and U.S. Pat. No. 3,117,532 issued to Moorhead. Anti-theft and door looking mechanisms have been described for trailers and semitrailers. See, e.g., U.S. Pat. No. 3,865,426 issued to Barnhart; U.S. Pat. No. 4,466,260 issued to Panetta and U.S. Pat. No. 4,627,248 issued to Haworth.

Thus, notwithstanding these many known designs, the art has produced very little in the way of practical techniques for securing the doors of semitractors.

BRIEF SUMMARY OF THE INVENTION

The present invention provides an anti-break-in device for automotive vehicles, particularly semitractors. The anti-break-in device is a door bar device for securing the doors of a vehicle, particularly a semitractor. The door bar is demountable, i.e., portable, and requires no special installation in the semitractor.

The foregoing, and other advantages of the present invention, is realized in one aspect thereof in a door bar device comprising a door bar for barring the door of an automotive vehicle of the type wherein the door has doorjambs, an inside door pull handle for opening the door and a space between the inside door pull handle and the door for receiving a hand. The door bar is configured and dimensioned to be positioned between the pull handle and the door and extends from a point prior to the pull handle across the door to beyond the door jamb to bar the door from being opened. Specifically, the door bar includes a rigid elongate unitary structure with a bar and a panel depending from, e.g., extending perpendicularly from, the bar. In other words, the bar has a longitudinal axis and the panel extends abaxially from the bar.

In use, the panel is positioned in the space between the door pull handle and the interior of the door, i.e., the panel is interposed between the door pull handle and the entrance of the door; the bar is consequently positioned with one end just prior to the door pull handle and the opposite end extending upon the door jamb.

Another aspect of the present invention includes a method of securing a door of a vehicle from within the vehicle where the vehicle is of the type having a ceiling and at least one door for entering and exiting the vehicle and has an inside door pull handle attached to the interior of the door for closing the door and a door jamb which frames the door opening and where the inside door pull handle has two side portions extending from the interior of the door and connected by a linear portion where the two side portions, the linear portion and a portion of the interior of the door facing the linear portion collectively defining a panel-receiving space. The method comprises the steps of: (a) providing a door bar comprising an demountable, rigid elongate unitary structure including a bar and a panel with (i) the bar having a top, a bottom, sides and oppositely extending ends, and dimensioned to span a distance from just prior to one of the side portions of the inside door pull handle to past the door jam of the door; and (ii) the panel having an edge integral with the bar and spaced apart from each of the ends and extending downwardly from the bottom of the bar; (b) orienting the top of the bar toward the ceiling of the vehicle; (c) positioning the panel in the panel-receiving space; and (d) lodging the bar against the door jamb of the door. The method includes the door bar having a pair of panels each extending downwardly from the bottom of the bar and spaced apart and parallel to each other, where the pair of panels is spaced apart at a distance sufficient to receive the inside door pull handle between the panels, and wherein prior to step (d), the method further comprises the step of receiving the inside door pull handle between the panels.

Yet another aspect of the present invention includes a method of making a door bar suitable for securing a door of a vehicle from within the vehicle, the vehicle of the type having at least one door for entering and exiting the vehicle, an inside door pull handle attached to the interior of the door for closing the door and a door jamb which frames the door opening, the method comprising the steps of: (a) dimensioning a bar to a length sufficient to span the distance from just prior to the inside door pull handle to past the door jamb of the door; and (b) rigidly connecting a first panel dimensioned to fit between the inside door pull handle and the door to the bar. The method of making the door bar further comprises the step of: (c) rigidly connecting a second panel, parallel to and spaced apart from the first panel, to the bar.

Other advantages and a fuller appreciation of the specific attributes of this invention will be gained upon an examination of the following drawings, detailed description of preferred embodiments, and appended claims. It is expressly understood that the drawings are for the purpose of illustration and description only, and are not intended as a definition of the limits of the invention.

BRIEF DESCRIPTION OF THE DRAWING(S)

The preferred exemplary embodiment of the present invention will hereinafter be described in conjunction with the appended drawing wherein like designations refer to like elements throughout and in which.

DETAILED DESCRIPTION OF THE INVENTION

The present invention relates broadly to door bar systems. However, the present invention is most particularly adapted for use in barring doors of a semitractor. Accordingly, the present invention will now be described in detail with respect to such endeavors; however, those skilled in the art will appreciate that such a description of the invention is meant to be exemplary only and should not be viewed as limitative on the full scope thereof.

The present invention provides a door bar device and a method of barring the doors of a semitractor to prevent break-ins. The present invention is characterized in that it can be used with existing doors of virtually all commercially available semitractors without any modification to the door system. These attributes are achieved through a novel combination of structural features.

Figure 5:
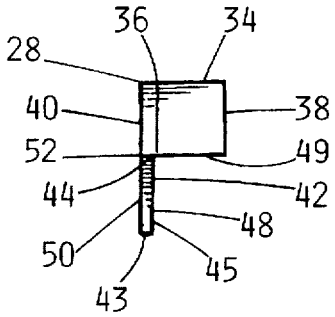
FIG. 5 is a front end view illustrating the alternate placement of the panel on the bar, so that a face and an elongate edge are substantially in the same plane.
Figure 8:
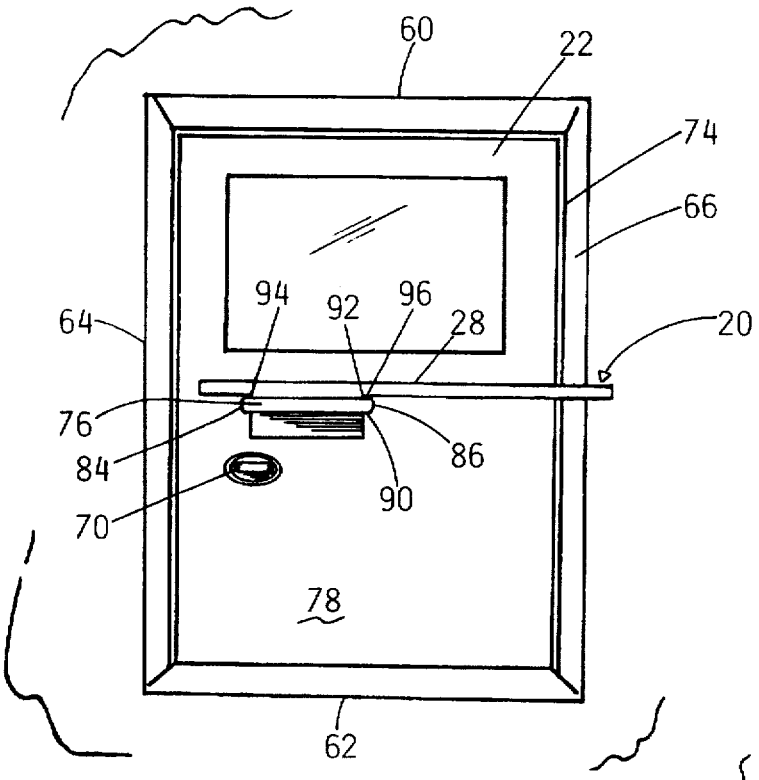
FIG. 8 is an illustration of the inside of a door of a semitractor with the embodiment of FIG. 1 positioned in accordance with the present invention.
Figure 6:
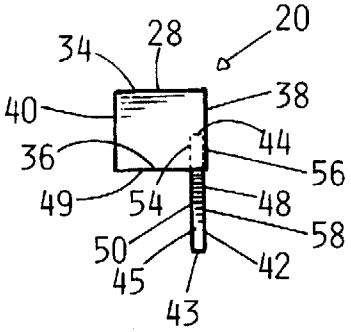
FIG. 6 is an enlarged front end view of an alternate embodiment for the door bar panel of FIG. 1.
Figure 7:
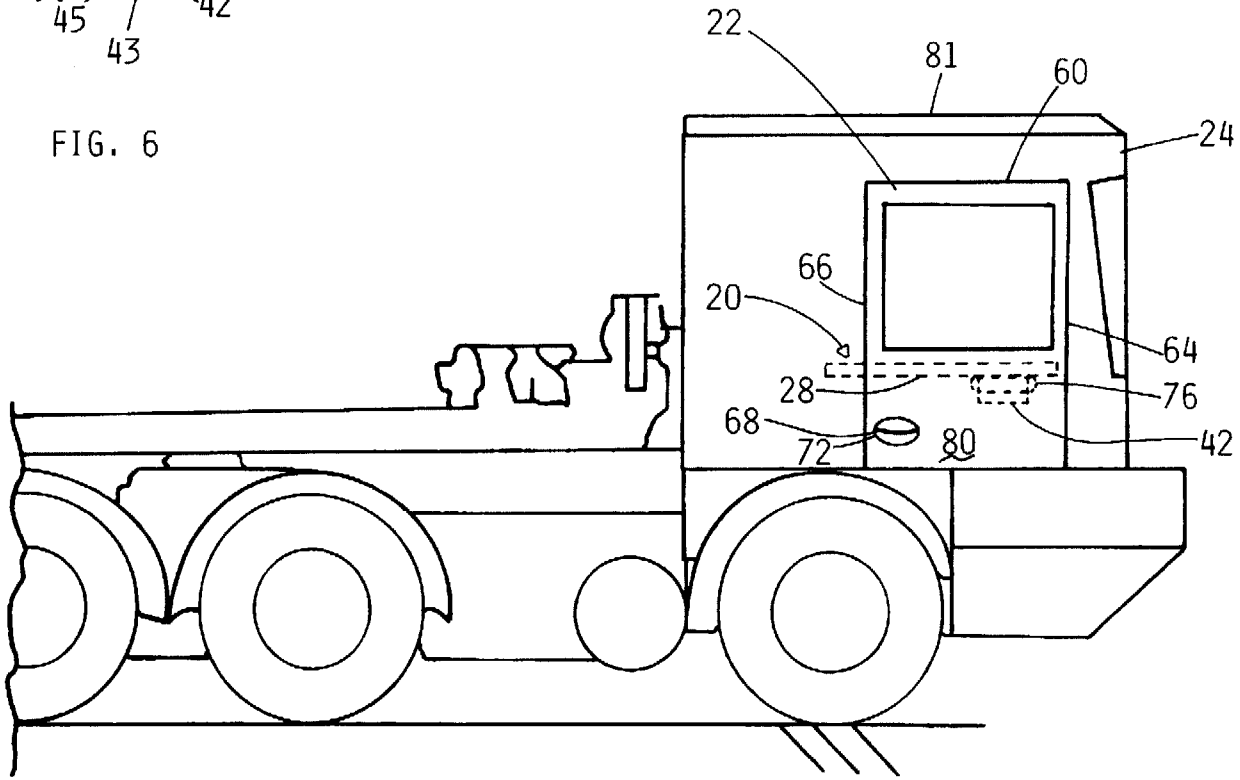
FIG. 7 is an illustration of a semitractor with the embodiment of FIG. 1 shown in hidden lines.

Reference is initially made to FIGS. 1–8 depicting a door bar in accordance with the present invention and designated generally as reference numeral 20 for barring a door 22 of a semitractor 24, as best seen in FIGS. 7 and 8. The door bar 20 includes a rigid elongate unitary structure 26 which includes a bar 28 having oppositely extending ends 30 and 32, a top 34, a bottom 36 and sides 38 and 40. A panel 42 depends, preferably perpendicularly, from bottom 36 of bar 28. As used herein, "panel" is meant to refer to a flat usually rectangular piece made to form part of a surface. Panel 42 has opposed elongate edges 43 and 44, opposed sides 45 and 46, and opposed faces 48 and 50.

Figure 1:
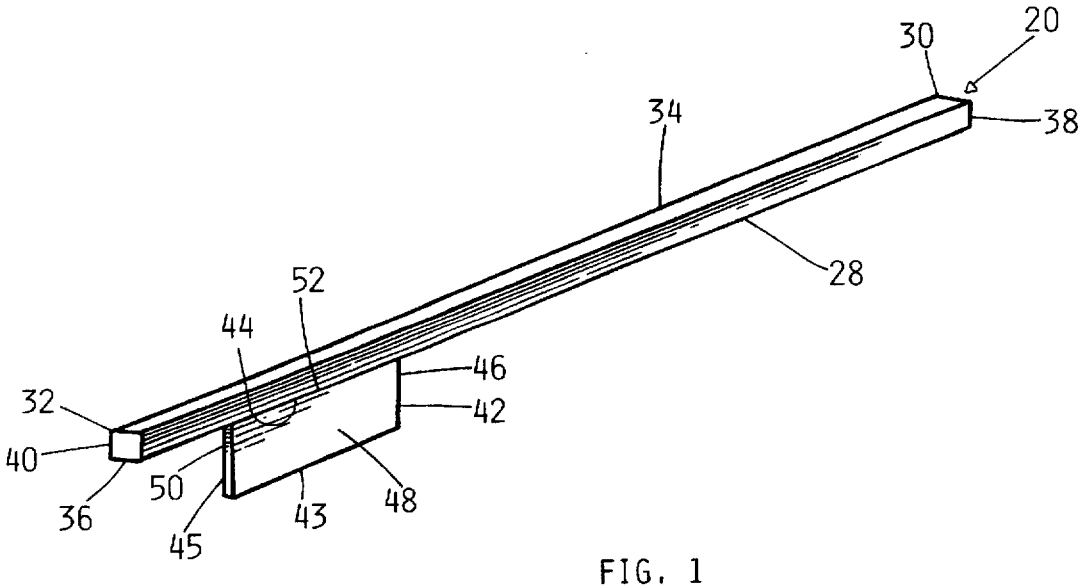
FIG. 1 is a perspective view of a preferred embodiment in accordance with the present invention.
Figure 2:
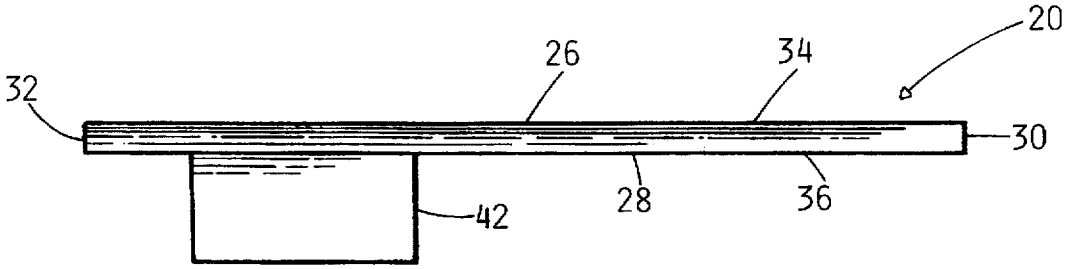
FIG. 2 is a side elevational view of the embodiment of FIG. 1.
Figure 3:
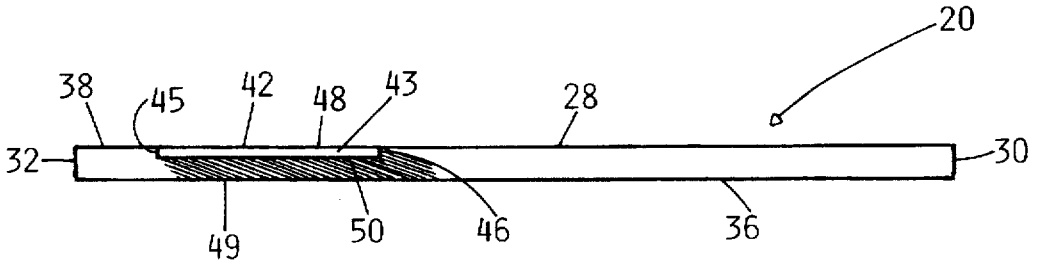
FIG. 3 is a bottom view of the embodiment of FIG. 1.
Figure 4:
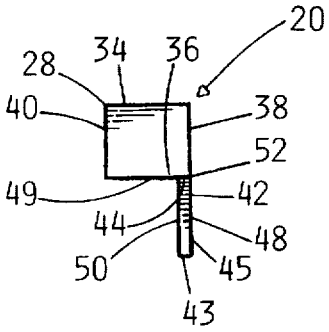
FIG. 4 is a front end view of the embodiment of FIG. 1.

As is best illustrated in FIG. 4, one of the faces of panel 42 is positioned so that side 38 of bar 28 and face 48 are in substantially in the same plane. As is appreciated by those skilled in the art, the door bar 20, illustrated in FIGS. 1–6 is useful for the right side door of the semitractor 24. To adapt the invention for use for the left side door, the door bar 20 is constructed in the exact same way, except that the opposite face 50 is positioned so that side 40 of bar 28 and face 50 are in substantially the same plane as is best shown in FIG. 5.

The width dimension of the panel 42 between opposed faces 48 and 50 is less than the width dimension of bottom 36, thus a width portion 49 of bottom 36 remains uncovered by panel 42.

Door bar 20 is suitably constructed of a high strength material having a minimum tensile strength of about 500 lbs/in$^2$, e.g., 3/16 gauge steel or injection molded thermoplastic. If door bar 20 is constructed of a metal, such as steel, panel 42 is suitably affixed to bar 28 at an interface 52 by, e.g., welding or brazing. Alternatively, as seen in FIG. 6, an elongate edge 44 of panel 42 is suitably positioned in a complementary recess 54 in bar 28 with a portion 56 of panel 42 housed and affixed inside bar 28 and the remainder portion 58 of panel extending perpendicularly from bar 28. Again side 38 and face 48 are in substantially the same plane. Likewise, the device as illustrated in FIG. 5, may be adapted in a similar manner by recessing a portion of panel 42 in a complimentary recess positioned along side 40, so that side 40 and face 50 are in substantially the same plane. Door bar 20 is also suitably constructed of injection molded thermoplastic wherein the entire structure 26, i.e., bar 28 and panel 42, are molded as one piece.

FIGS. 7 and 8 illustrate door 22 of semitractor 24. Door 22 is swingably mounted, as is usual, in a doorway, as shown, consisting of a lintel 60, a sill 62 and jambs 64 and 66, and having a lock mechanism 68 against jamb 66. Lock mechanism 68 consists of inside and outside handles 70 and 72, respectively. Door 22 closes against a stop 74 covering lintel 60 and door jambs 64, 66. Door 22 also includes an inside door pull handle 76 for pulling the door closed or pushing it open. The door also has an interior door surface 78 facing the interior of the semitractor 24 and an exterior door surface 80 facing the outside of the semitractor 24. Semitractor 24 also has a ceiling 81.

Figure 9:
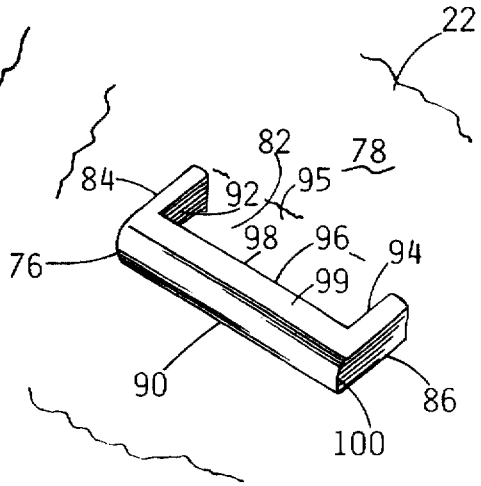
FIG. 9 is a breakaway illustration of the interior of an inside door of a semitractor showing the interior door pull handle and the space between the interior door pull handle and the door, without the present invention inserted in the space between the interior door pull handle and the door.

As is shown in FIG. 9, the door pull handle 76 is conventionally made having two side portions 84, 86 connected by a linear portion 90. Each side portion 84, 86 has an inside 92, 94 respectively. Likewise, linear portion 90 has an inside 96. The inside 92, 94 of the two side portions 84, 86, together with the inside 96 of the linear portion 90, and a portion 95 of the interior surface of the door facing the linear portion 90, collectively define a space 82 between the pull handle 76 and the interior surface 78 of the door 22. The length of the inside 96 of linear portion 90 of pull handle 76 defines an inner length 98. The linear portion 90 of the pull handle 76 also has a thickness 99 and a depth 100. Space 82 between inside door pull handle 76 and the interior door surface 78 is sufficiently dimensioned for receiving a hand.

Bar 28 is dimensioned between ends 30 and 32 to span a distance from just prior to the inside pull handle 76 to past the door jamb 66 of the door 22, while perpendicular panel 42 is configured and dimensioned to be received in a space 82 between the inside pull handle 76 and the interior door surface 78 of door 22. Thus end 32 extends just beyond side portion 84 of inside door pull handle 76.

Bar 28 is shown as a rectangular parallelepiped structure, i.e., top 34 and bottom 36 are parallel and opposed, extending ends 30 and 32 are parallel and opposed, and sides 38 and 40 are parallel and opposed. It is understood, however, that bar 28 is suitably other configurational profiles, such as cylindrical, provided that the bar extends a distance from just before the pull handle 76 to beyond the door jamb 66.

The panel 42 is suitably dimensioned to be interposed between the inside door pull handle 76 and the door 22. The panel 42 is dimensioned from side 45 to side 46 to be less than inner length 98 of pull handle 76 and is preferably dimensioned to be at least 90 percent as long as inner length 98. Panel 42 is dimensioned from elongate edge 43 to opposite elongate edge 44 to extend beyond the pull handle depth 100 and is preferably dimensioned to be at least 3 times greater than pull handle depth 100. The location of panel 42 from ends 30 and 32 depends on the customary placement of door pulls on the interior door surface of doors of semitractors and is easily discerned by measuring these dimensions on conventionally produced vehicles.

In operation, door bar 20 is simply used by providing the door bar 20, orienting the door bar 20 with the top 34 of bar 28 facing the ceiling 81 of semitractor 24, then interposing the panel 42 between the door pull handle 76 and the door 22, i.e., positioning the panel 42 in space 82, with end 30 of bar 28 extending beyond door jamb 66, and lodging end 30 against door jamb 66. End 32 extends slightly beyond side portion 84 and rests on it. Preferably end 32 extends 2 inches beyond side portion 84. Thus, end 30 rests against door jamb 66 where end 30 is held against the door jamb 66. Panel side 45 is lodged against inside 92 of side portion 84 of the pull handle 76 so as to be quickly removed in the event of the need for a quick exit from the semitractor; for example, in the case of fire, storm, etc. No other installation parts are necessary. Once positioned a would-be burglar will be thwarted in an attempted burglary/break-in because the door cannot swing open because the door bar device is lodged between the door pull handle 76 and the door jamb 66. Even if the door is opened partly, the strength of the material of the bar does not readily permit breaking or cutting to gain entry to the semitractor.

Figure 10:
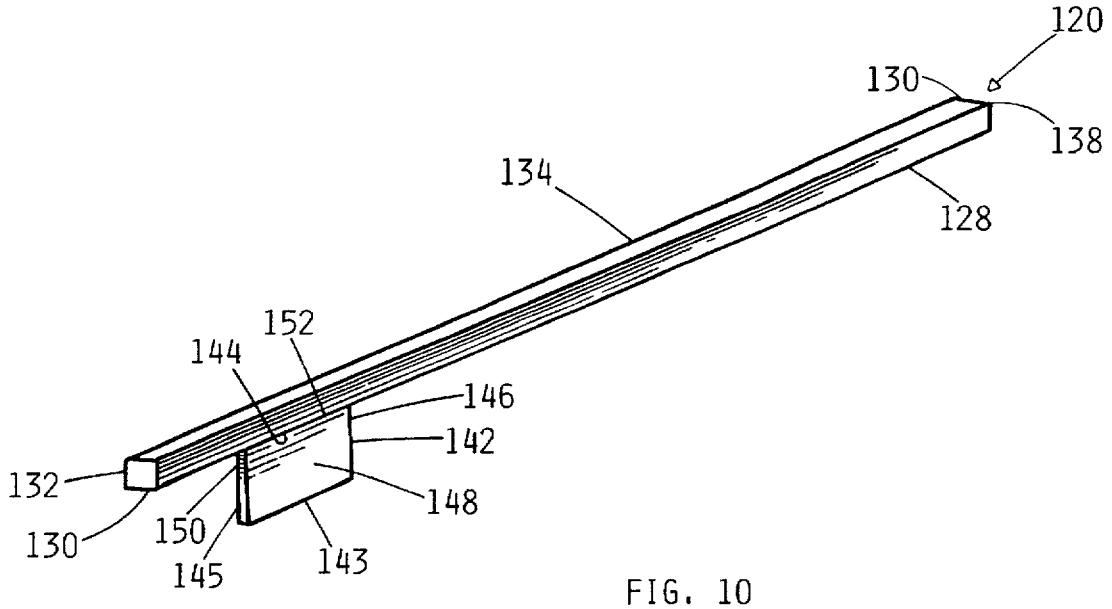
FIG. 10 is a perspective view of a second embodiment in accordance with the present invention.
Figure 12:
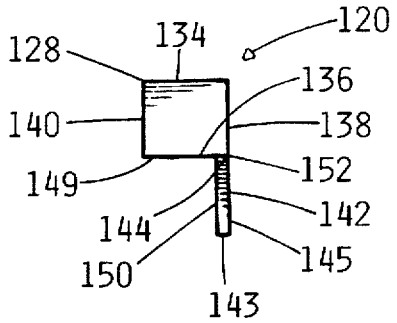
FIG. 12 is a front end view of the embodiment of FIG. 10.
Figure 11:
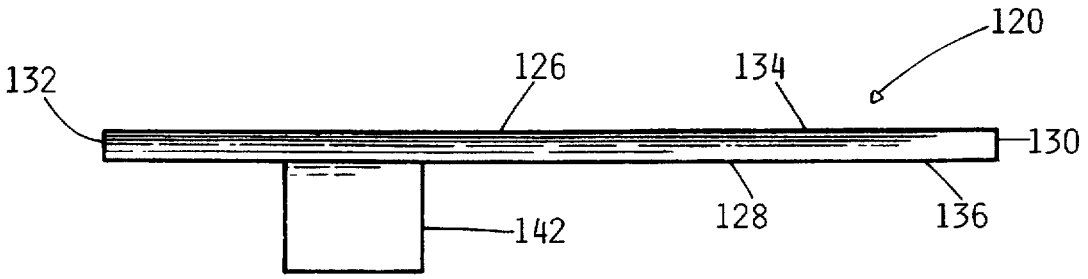
FIG. 11 is a side plan view of the embodiment of FIG. 10.

FIGS. 10–16 illustrate two other embodiments in accordance with the present invention. These embodiments are suitably utilized in alternate door configurations associated with the variety of semitractors. As seen in FIGS. 10–12 a door bar 120 has a bar 128 having opposed ends 130 and 132, respectively, as previously described for door bar 20, wherein similar numbers are used to identify the same elements, and a perpendicularly extending panel 142 similar to door bar 20. Panel 142 has parallel opposed elongate edges 143 and 144, parallel opposed sides 145, 146, and parallel opposed faces 148, 150. One of the faces 148 of panel 142 is positioned so that side 138 and face 148 are in substantially the same plane. Door bar 120 is suitably constructed and configured the same as described hereinbefore for door bar 20 except that the positioning and dimensions of panel 142 along bar 128 differs. Panel 142 is positioned more centrally along bar 128 and it has a more square appearance than rectangular. In all other aspects, door bar 120 is the same as door bar 20 and is made of the same materials and used in the same manner as previously described herein for door bar 20. Likewise, the door bar 120 may be constructed for the left side door, as well as, the right side door as was described for door bar 20, by positioning one of the faces 150 of the panel 142 in position so that side 140 and face 150 are substantially in the same plane. Also the panel 142 may be affixed inside a complimentary recess in the bar 128 as was described for door bar 20.

Figure 13:
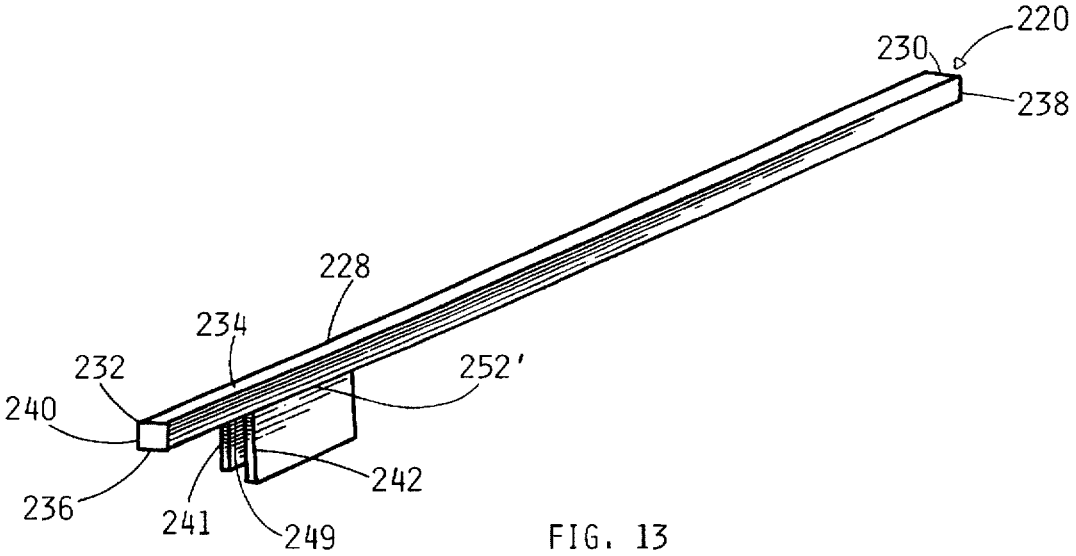
FIG. 13 is a perspective view of a third embodiment in accordance with the present invention.
Figure 14:
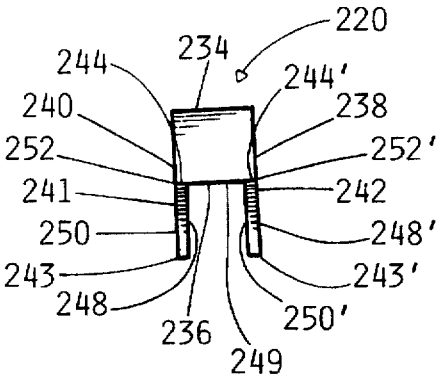
FIG. 14 is a front end view of the embodiment of FIG. 13.
Figure 15:
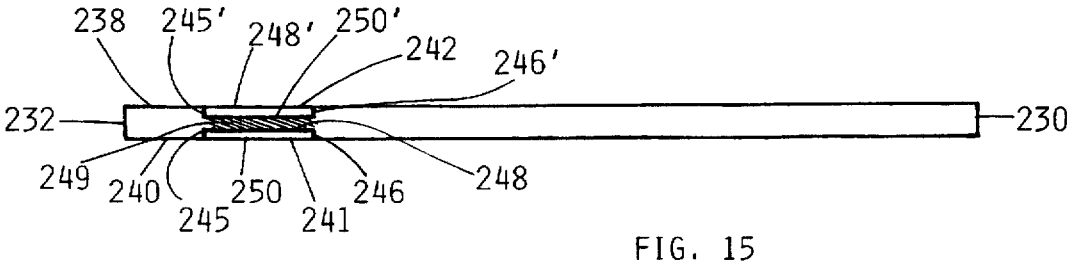
FIG. 15 is a bottom view of the embodiment of FIG. 13.

As seen in FIGS. 13–15, a door bar 220 includes a bar 228 having oppositely extending ends 230 and 232, a top 234, a bottom 236, sides 238 and 240 respectively. Two panels 241 and 242 respectively, extend in parallel manner, perpendicularly from bottom 236 of bar 228. Panel 241 has opposed and parallel elongate edges 243 and 244, opposed and parallel sides 245 and 246, and opposed and parallel faces 248 and 250. Panel 242 has opposed and parallel elongate edges 243' and 244', opposed and parallel sides 245' and 246', and opposed and parallel faces 248' and 250'. As best seen, in FIG. 14, panels 241 and 242 are positioned along bar 228 so that face 250 is coplanar with bar side 240 and face 248' is coplanar with bar side 238. Face 250' of panel 241 is parallel to face 248 of panel 242. A pull handle receiving area 249 is defined on bottom 236 between panels 241 and 242.

Preferably panels 241 and 242 are identically constructed. Because of its unique structure, door bar 220 may be used on either the left or the right side door of the semitractor.

Like door bar 20, door bar 220 is suitably constructed of a high strength material having a minimum tensile strength of about 500 lbs/in$^2$, e.g., 3/16 gauge steel or injection molded thermoplastic. Door bar 220 is also suitably constructed of injection molded thermoplastic, wherein the entire device has a unitary construction from molding the device in one piece.

Figure 16:
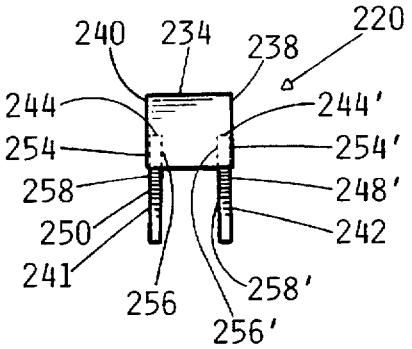
FIG. 16 is a front end view of an alternate embodiment for the door bar panels of FIG. 13.

If door bar 220 is constructed of a metal, such as steel, panels 241, 242 are, e.g., suitable constructed of a metal, e.g., a 3/16 gauge steel. Panels 241 and 242 are suitably affixed to bar 228 at interfaces 252, 252' respectively via, e.g., welding or brazing. Alternately, as best shown in FIG. 16, panels 241 and 242 are positioned in recesses 254 and 254' respectively, in bar 228, in the same fashion as described for door bar 20 hereinabove. Thus elongate edge 244 of panel 241 is positioned in a complementary recess 254 in bar 228 with a portion 256 of panel 241 housed and affixed inside bar 228 and the remainder portion 258 of panel extending perpendicularly from bar 228. Again, side 240 and face 250 are in substantially the same plane. The elongate edge 244' of panel 242 is positioned in a complementary recess 254' in bar 228 with a portion 256' of panel 242 housed and affixed inside bar 228 and the remainder portion 258' of panel extending perpendicularly from bar 228. Again, side 238 and face 248' are in substantially the same plane.

Bar 228 is configured and dimensioned to be positioned between the inside door pull handle 76 and the door 22. Bar 228 is dimensioned between ends 230 and 232 to span a distance from just prior to the inside pull handle 76 to past the door jamb 66 of the door 22, while the perpendicular panels 241, 242 are each individually configured and dimensioned to be received in a space 82 between the inside pull handle 76 and the interior door surface 78 of door 22.

Bar 228 is shown as a rectangular parallelepiped structure with a parallel opposed top 234 and a bottom 236, parallel opposed extending ends 230 and 232, and parallel opposed sides 238 and 240. It is understood, however, that bar 228 is suitably other configurational profiles, such as cylindrical, provided that the bar extends a distance from just before the pull handle 76 to beyond the door jamb.

The panels 241, 242 are each dimensioned from side 245 to side 246 and from side 245' to 246' to be less than inner length 98 of pull handle 74 and are preferably dimensioned to be at least 90 percent as long as inner length 98. Panels 241, 242 are each dimensioned from elongate edge 243 to opposite elongate edge 244, and from elongate edge 243' to opposite elongate edge 244' to extend beyond the pull handle depth 100 and is preferably dimensioned to be at least 11 times greater than pull handle depth 100. The location of panels 241, 242 from ends 230 and 232 depends on the customary placement of door pulls on the interior doors of semitractors and is easily discerned by measuring these dimensions on conventional produced vehicles.

In operation, door bar 220 is simply used by providing door bar 220, orienting the door bar 220 with the top 234 of bar 228 facing the ceiling 81 of the vehicle 24, then interposing one of the panels 241, 242 between the door pull handle 76 and the door 22, i.e., positioning one of the panels 241, 242 in space 82, receiving pull handle 76 between panels 241, 242, e.g., with the pull handle receiving area 249 resting on pull handle 76, with the other panel 242, 241 extending over the pull handle 76, and with end 230 of bar 228 extending beyond door jamb 66, and lodging end 230 against door jamb 66. The end 232 extends just beyond side portion 84 of pull handle 76. Preferably end 232 extends 2 inches beyond side portion 84. Thus door bar 220 is lodged between the door pull handle 76 and the door jamb 66, securing the door from the interior of the vehicle to prevent break-ins. Panel sides 245 and 245' are lodged against inside 92 of side portion 84 of pull handle 76 so as to be quickly removed in event of the need for a quick exit from the semitractor; for example, in the case of fire, storm, etc.

Preferably, each bar 28, 128, 228 of door bar 20, 120, 220, respectively, is straight.

In summary, the present invention provides simple, effective anti-opening/anti-burglary device for semitractor doors. No special installation is necessary, such as fasteners, brackets, etc. There is special need in the trucking industry for safety and protection of drivers.

While the present invention has now been described and exemplified with some specificity, those skilled in the art will appreciate the various modifications, including variations, additions, and omissions, that may be made in what has been described. Accordingly, it is intended that these modifications also be encompassed by the present invention and that the scope of the present invention be limited solely by the broadest interpretation that lawfully can be accorded the appended claims.

I claim:

1. A door bar suitable for securing a door of a vehicle having at least one door for entering and exiting the vehicle, an inside door pull handle attached to the interior of the door for closing the door and a door jamb which frames the door opening, comprising a demountable, rigid elongate unitary structure configured and dimensioned to traverse the door and door jamb, including a bar and a single panel;

said bar having a bottom, sides and oppositely extending ends, and dimensioned to span a distance from the inside door pull handle to past the door jamb of the door, said bar bottom having a bar bottom width dimension defined perpendicular to said sides;

said panel having an edge integral with said bar, spaced apart from each of said ends of said bar and extending downwardly from said bottom of said bar, said panel having a panel width dimension, said panel width dimension being sized less than said bar bottom width dimension, said panel for being sandwiched between the inside door pull handle and the door.

2. The door bar of claim 1, wherein said door bar comprises a material having a minimum tensile strength of about 500 lbs/in$^2$.

3. The door bar of claim 2, wherein said material is a 3/16 gauge steel or an injection molded thermoplastic.

4. The door bar of claim 1, wherein said panel comprises a rectangular solid having a top edge, a bottom edge, a pair of opposed side edges and a pair of opposed faces.

5. The door bar of claim 4, wherein said top edge of said panel is attached to said bottom of said bar.

6. The door bar of claim 5, wherein said top edge of said panel is held and affixed to a recess in said bottom of said bar.

7. The door bar of claim 5, wherein said panel extends perpendicularly from said bottom of said bar.

8. The door bar of claim 6, wherein one of said faces of said panel is coplanar with one of said sides of said bar.

9. A door bar suitable for securing a door of a vehicle having at least one door for entering and exiting the vehicle, an inside door pull handle attached to the interior of the door for closing the door and a door jamb which frames the door opening, comprising a demountable, rigid elongate unitary structure configured and dimensioned to traverse the door and door jamb, including a bar and a pair of panels;

said bar having a bottom, sides and oppositely extending ends, and dimensioned to span a distance from the inside door pull handle to past the door jamb of the door, said bar bottom having a bar bottom width dimension defined perpendicular to said sides;

each said panel having an edge integral with said bar, spaced apart from each of said ends of said bar and from each other each said panel extending downwardly from said bottom of said bar, each said panel disposed on the same end of said bar and with one said panel spaced in a plane parallel to the other said panel, each said panel comprising a rectangular solid having a top edge, a bottom edge, a pair of opposed side edges and a pair of opposed faces, one of said panels disposed for interposing between the inside door pull handle and the door, each of said panel having a panel width dimension, said panel width dimension being sized less than said bar bottom width.

10. The door bar of claim 9, wherein, in use, said panels are positioned to extend over the pull handle.

11. A portable door bar for barring the door of an automotive vehicle having a door with door jambs and an inside door pull handle for closing the door, said door bar comprising (a) a horizontal bar having a bar bottom, sides and opposed ends, said bar having a bar bottom width dimension defined perpendicular to said sides and (b) a vertical panel depending from said bar and spaced apart from said ends of said bar, said panel having a panel width dimension, said panel width dimension being sized less than said bar bottom width dimension, said panel configured and dimensioned to be sandwiched between the pull handle and the door, and said bar being adapted for transversing the door and door jamb.

12. A door bar suitable for securing a door of a vehicle, having a door with door jambs and an inside door pull handle for closing the door, said door bar comprising a rigid, elongate unitary structure having a bar member and a panel member;

said bar member having a top, a bottom, a pair of sides and a longitudinal axis terminating in oppositely extending ends, said bottom of said bar member having a bottom width dimension defined perpendicular to said sides and said panel member (i) having a top edge, a bottom edge, a pair of opposed side edges and a pair of opposed faces with a panel width dimension sized less than said bottom width dimension of said bar member, (ii) dimensioned to be interposed between the pull handle and the door, and (iii) extending abaxially from said bar member and rigidly connected at said top edge to said bottom of said bar member, one of said faces coplanar with one of said sides of said bar member, said panel member positioned asymmetrically along said longitudinal axis of said bar member proximate one end of said pair of oppositely extending ends;

said bar member dimensioned from one end to the other end to allow said one end to extend over said door pull handle, to allow the panel to be sandwiched between the pull handle and the door, and to allow a remainder of the bar member to traverse the door with the second end extending to the door jamb.

13. A method of securing a door of a vehicle from within the vehicle, the method comprising the steps of:

(a) providing a vehicle having a ceiling and at least one door for entering and exiting the vehicle and closing an opening of the vehicle, an inside door pull handle attached to the interior of the door for closing the door and a door jamb which frames the door opening, the inside door pull handle having two side portions extending from the interior of the door and connected by a linear portion; the two side portions, the linear portion and a portion of the interior of the door facing the linear portion collectively defining a panel-receiving space;

(b) providing a door bar comprising a demountable, rigid elongate unitary structure including a bar and a panel;

(i) said bar having a top, a bottom, sides and oppositely extending ends, and dimensioned to span a distance from just prior to one of the side portions of the inside door pull handle to past the door jam of the door, said bar bottom having a bar bottom width dimension defined perpendicular to said sides;

(ii) said panel having an edge integral with said bar and spaced apart from each of said ends and extending downwardly from said bottom of said bar, said panel having a panel width dimension sized less than said bar bottom width dimension;

(c) orienting said top of said bar toward the ceiling of the vehicle;

(d) positioning said panel in said panel-receiving space; and (e) lodging said bar against the door jamb of the door.

14. The method of claim 13, wherein said door bar has a pair of panels each extending downwardly from said bottom of said bar on one of the oppositely extending ends and with said pair of panels spaced apart and parallel to each other, said pair of panels spaced apart at a distance sufficient to receive the inside door pull handle between said panels, and wherein prior to step (d), the method further comprises the step of receiving said inside door pull handle between said panels.

15. A door bar suitable for securing a door of a vehicle comprising, a demountable, rigid elongate unitary structure, including single panel and a bar from which said panel extends;

said bar having a pair of opposed ends, said panel having an edge integral with said bar, and spaced proximate one of said ends of said bar, said panel having a panel width dimension, said panel width dimension being sized less than a bar bottom width dimension defined perpendicular to sides of said bar.

16. The door bar of claim 15 in combination with a vehicle having at least one door for entering and exiting the vehicle and closing an opening of the vehicle, an inside door pull handle attached to the interior of the door for closing the door, a hand receiving space between the pull handle and the interior of the door and a door jamb which frames the door opening, said bar dimensioned to span a distance from the inside door pull handle to past the door jamb of the door, and said panel positioned in and received by the hand receiving space.

* * * * *